US005294117A

United States Patent [19]

Huang

[11] Patent Number: 5,294,117

[45] Date of Patent: Mar. 15, 1994

[54] RACQUET GRIP

[76] Inventor: Ben Huang, 19472 Woodlands La., Huntington Beach, Calif. 92648

[21] Appl. No.: 73,576

[22] Filed: Jun. 7, 1993

Related U.S. Application Data

[63] Continuation-in-part of Ser. No. 972,146, Nov. 17, 1992.

[51] Int. Cl.[5] ..... A63B 49/00

[52] U.S. Cl. ..... 273/75; 273/81.6; 273/81 B

[58] Field of Search ..... 273/73 R, 75, 81 R, 273/81 B, 81 D, 165, 81.5, 81.6, 67 R, 67 A, 67 C, 67 D, 67 DA

[56] References Cited

U.S. PATENT DOCUMENTS

| | | | |
|---|---|---|---|
| 578,734 | 3/1897 | Fanning . | |
| 1,940,104 | 12/1933 | Russell et al. | 273/81.5 |
| 2,166,044 | 7/1939 | Fletcher | 273/81.6 |
| 2,177,143 | 10/1939 | Lamkin | 273/81.6 |
| 2,205,769 | 6/1940 | Sweetland . | |
| 2,222,121 | 11/1940 | Roberts . | |
| 2,954,697 | 10/1960 | Geist . | |
| 3,897,058 | 7/1975 | Koch . | |
| 4,035,089 | 7/1977 | Schwartz et al. . | |
| 4,174,109 | 11/1979 | Gaiser | 273/81.6 |
| 4,347,280 | 8/1982 | Lau et al. | 273/67 DB X |
| 4,509,228 | 4/1985 | Landsberger . | |
| 4,512,574 | 4/1985 | Klaila . | |
| 4,533,139 | 8/1985 | Goldin et al. . | |
| 4,635,936 | 1/1987 | Becker et al. . | |
| 4,804,183 | 2/1989 | Doran et al. . | |

FOREIGN PATENT DOCUMENTS

| | | | |
|---|---|---|---|
| 462155 | 3/1937 | United Kingdom | 273/81 |
| 870021 | 6/1961 | United Kingdom | 273/81.6 |
| 979242 | 1/1965 | United Kingdom | 273/81.5 |

*Primary Examiner*—Vincent Millin
*Assistant Examiner*—Raleigh W. Chiu
*Attorney, Agent, or Firm*—Fulwider Patton Lee & Utecht

[57] ABSTRACT

A shock absorbing grip for a ball-struck impact imparting device such as a tennis racquet having a resilient compressible body which overlies the handle. An inflatable tube carried by the body is inflated by an air pump to selectively pressurize the tube to cause the tube to define a raised profile along the body adjacent the tube.

11 Claims, 3 Drawing Sheets

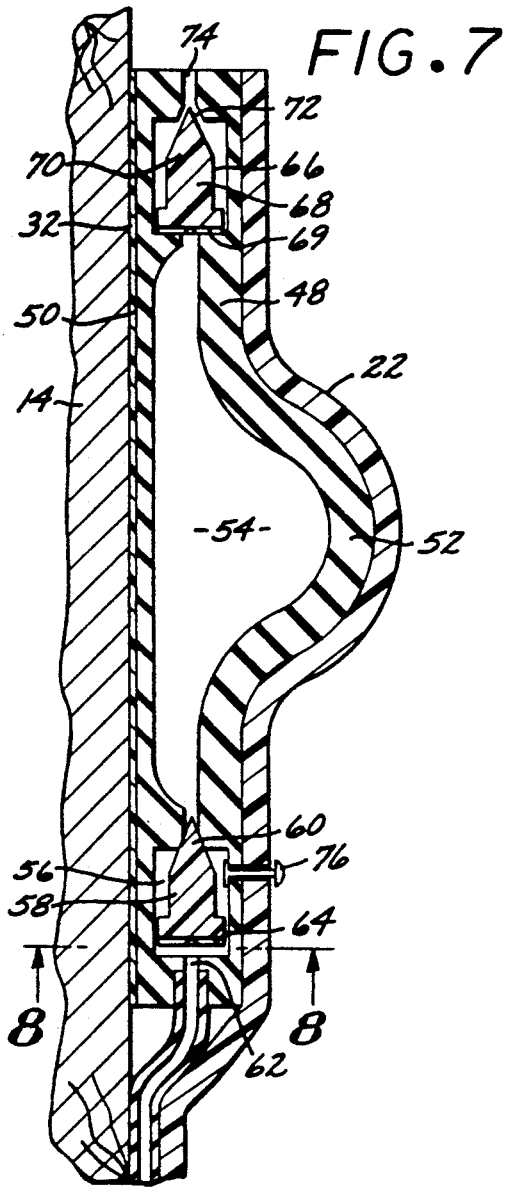
FIG. 7
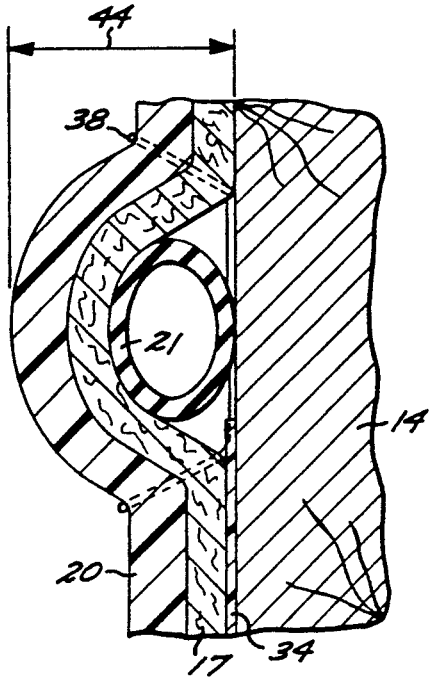
FIG. 9
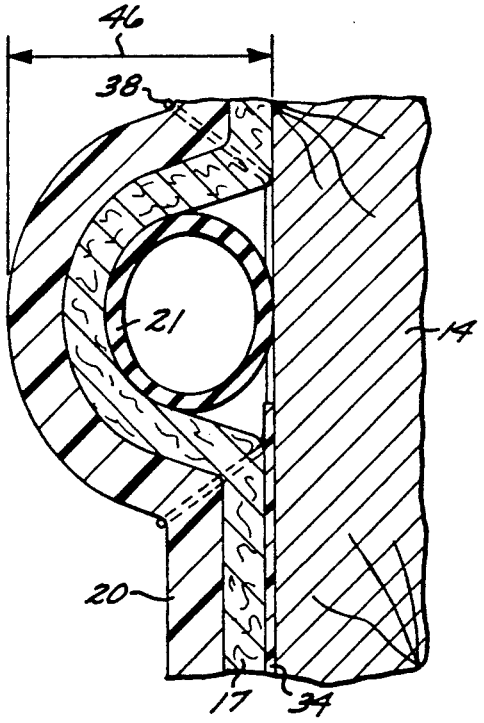
FIG. 10
FIG. 8
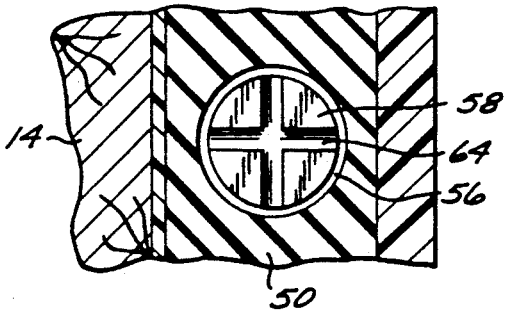

FIG. 11
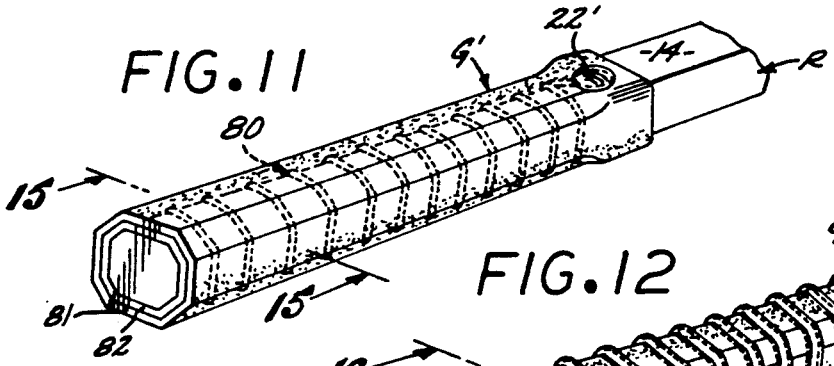
FIG. 12
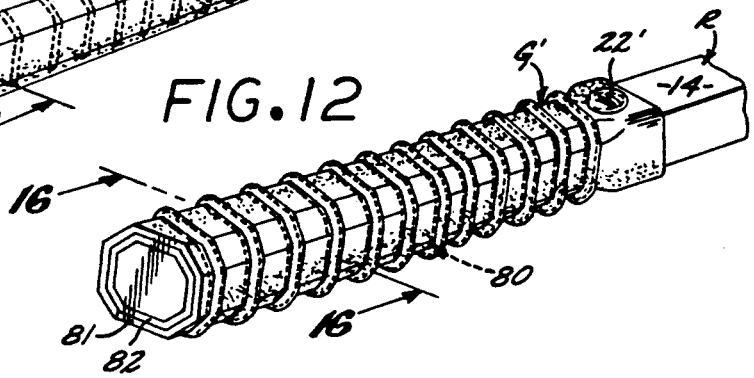
FIG. 13
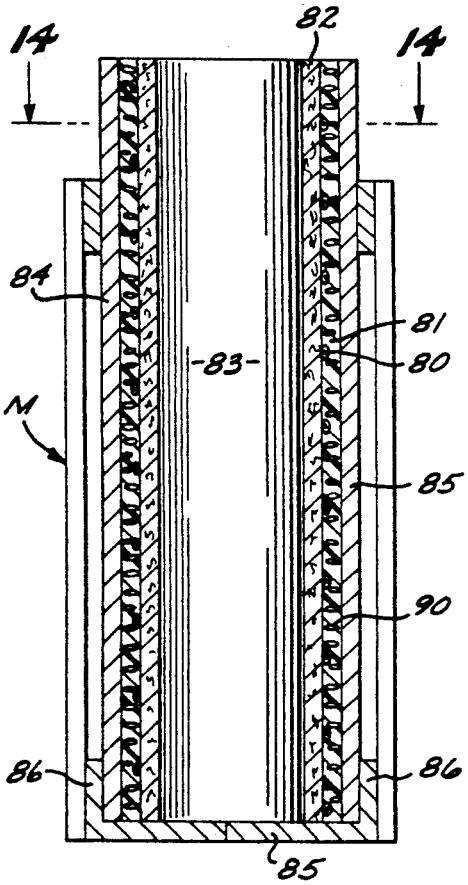
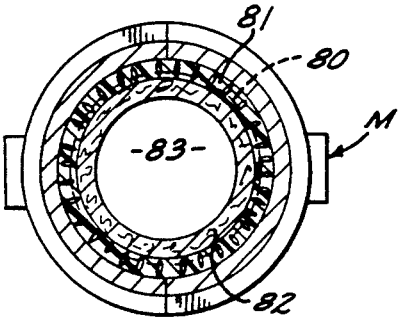
FIG. 14
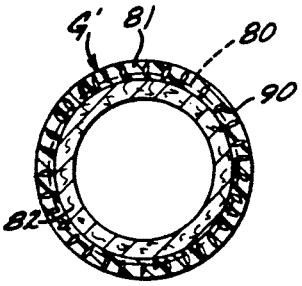
FIG. 15
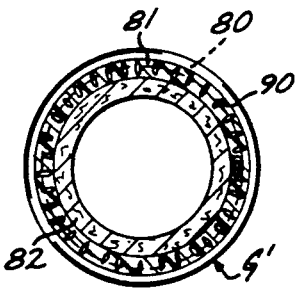
FIG. 16

RACQUET GRIP

This is a continuation-in-part of copending application Ser. No. 07/972,146 filed on Nov. 17, 1992.

BACKGROUND OF THE INVENTION

The present invention relates to an improved shock absorbing grip to be applied to ball-struck impact imparting devices, as for example, tennis rackets, racquetball rackets, golf clubs, and baseball bats.

Accurate placement of a ball struck by a tennis racquet or the like is greatly dependant upon the ability of the racquet grip to permit the racquet user to maintain firm hand contact with the racquet grip. The problem of providing a firm hand-to-racquet grip contact is complicated when the racquet user's hand is moist from perspiration. Slippage between the racquet user's hand and the racquet grip is not only detrimental to accuracy of ball placement, but additionally, can cause the formation of blisters on the racquet user's hand.

It is well-known that shock generated by impact between a ball-struck device such as a tennis racquet and a tennis ball can adversely affect muscle tissue and arm joints, such as elbow joints. Such shock often results in "tennis elbow" which is a painful affliction commonly experienced by active tennis players. Medical theories attribute "tennis elbow" to continuous exposure of the playing arm of a tennis player to shock and vibration generated by striking a tennis ball with a tennis racquet. The energy generated is usually of high frequency and short duration with rapid decay and which is often known as "impact shock". Various types of grips have been proposed for inhibiting "tennis elbow", however, such grips have not completely solved such problem.

SUMMARY OF THE INVENTION

The improved shock absorbing grip of my present invention utilizes an inflatable tube carried by a cushioned body which may be formed of bonded-together polyurethane and textile layers, and a pump connected to the tubing to selectively pressurize the tube and thereby expand the exterior surface of the grip adjacent the tube in a raised spiral configuration or profile along the length of the grip. The amount of air forced into the tube enables a racquet user to adjust the grip profile defined by the inflated tube to the proper height for preventing slippage of the handle relative to the user's hand. In this manner, the potential blistering of the user's hand is reduced. Also, the inflated tube insures a firm grip on the racquet handle, even when the ball is hit off-center relative to the head of the racquet. The inflatable tube also cushions the user's hand against shock and provides maximum vibration absorbing characteristics. Accordingly, "tennis elbow" is inhibited to a greater extent than is the case with prior grips. Preferably, the pump is formed as an integral part of the grip, and is so located that it will not interfere with the usage of the grip. The tube may be stitched to the resilient, compressible cushioned body by a length of a thread having traverse segments that extend across the body immediately adjacent the tube. The tube may also be molded into the polyurethane layer.

BRIEF DESCRIPTION OF THE DRAWINGS

FIG. 7 is an enlarged sectional view taken along line 7—7 of FIG. 2 showing the pump;

FIG. 8 is a horizontal sectional view taken in enlarged scale along line 8—8 of FIG. 7;

FIG. 9 is an enlarged vertical sectional view taken along line 9—9 of FIG. 2 with the inflatable tube in its relaxed condition;

FIG. 10 is a view similar to FIG. 9, but showing the tube in an inflated condition;

FIG. 11 is a perspective view of a second form of a shock absorbing grip embodying the present invention attached to the handle of a ball-struck racquet with the inflatable tube in its relaxed condition;

FIG. 12 is a view similar to FIG. 11, but showing the tube in an inflated position;

FIG. 13 is a central vertical sectional view showing a mold which may be employed to form the grip of FIGS. 11 and 12;

FIG. 14 is a horizontal sectional view taken along lines 14—14 of FIG. 13;

FIG. 15 is a cross sectional view taken in enlarged scale along line 15—15 of FIG. 11; and FIG. 16 is a horizonal sectional view taken in enlarged scale along line 16—16 of FIG. 12.

DETAILED DESCRIPTION OF PREFERRED EMBODIMENTS

Figure 1:
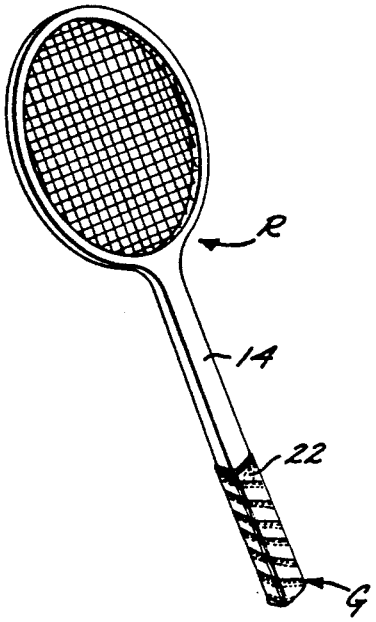
FIG. 1 is a perspective view of an improved shock absorbing grip embodying the present invention attached to the handle of a ball-struck racquet.
Figure 2:
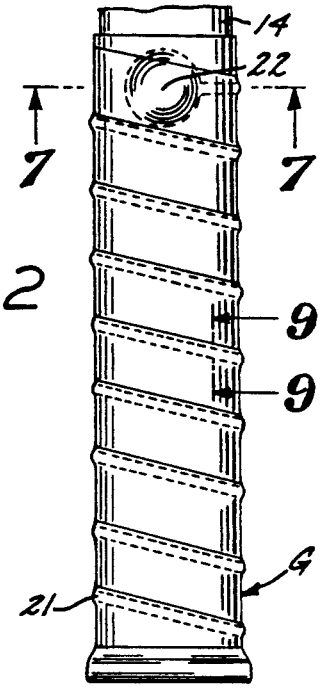
FIG. 2 is a broken front elevational view of said shock absorbing grip spirally wrapped around the handle of the racquet of FIG. 1.

Referring to the drawings, the improved shock absorbing grip G of the present invention is shown in FIGS. 1 and 2 attached to the handle 14 of a racquet R. The grip G includes an elongated resilient, compressible body, generally designated 16, which is preferably formed of an open-pored textile layer, such as felt generally designated 17, having an inner surface 18 which is adhered to the racquet handle 14. The grip also includes a smooth, closed pore polyurethane layer, generally designated 20 which is bonded to the textile layer 17, as shown particularly in FIGS. 9 and 10. Body 16 is configured as a unitary strip which is spirally wrapped about the racquet handle 14 in the manner depicted in FIGS. 1 and 2. An inflatable tube 21 is carried by the compressible body 16 in a manner described hereinafter. Such tube 21 is connected to an air pump, generally designated 22, also carried by the compressible body 16

Figure 3:
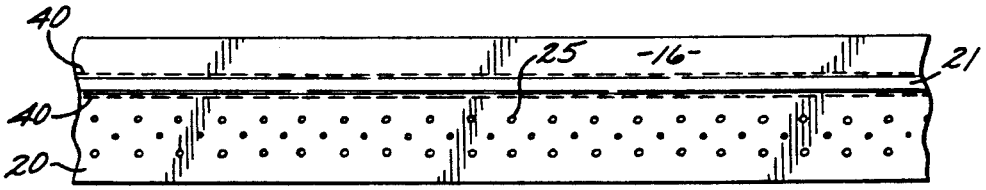
FIG. 3 is a broken exterior view of said grip.
Figure 4:
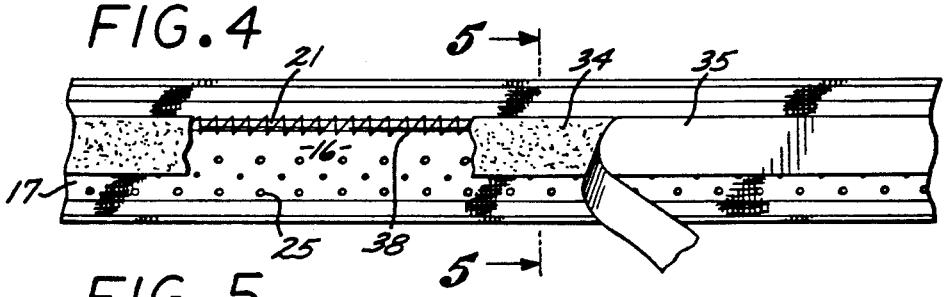
FIG. 4 is an interior view of said grip.

Preferably, the polyurethane layer 20 is formed with pores (not shown) which extend vertically, i.e., generally normal to the longitudinal axis of racquet handle 14 when the grip is affixed to such handle. The polyurethane layer 20 may be formed in a conventional manner by coating one side of a felt strip with a solution of polyurethane (e.g., polyester or polyether) dissolved in dimethyl formamide (DMF), immersing the coated strip in water baths to displace the DMF and to cause the urethane to coagulate, and finally driving off the water by the application of pressure and heat. In this manner, pores extending perpendicularly relative to the strip's longitudinal axis are formed, while the underside of the polyurethane layer is bonded to the outer surface of the felt strip. A plurality of perforations 25 may extend through the polyurethane and felt layers, as shown in FIGS. 3 and 4. In the interest of clarity such perforations are not shown in the other figures.

Figure 5:
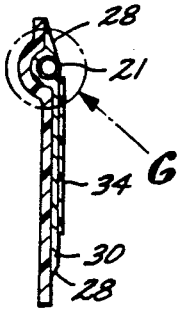
FIG. 5 is a vertical sectional view taken along line 5—5 of FIG. 4.
Figure 6:
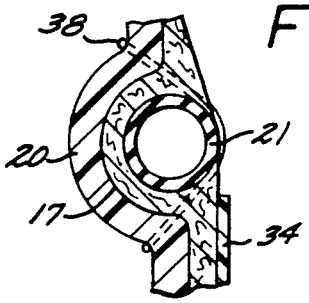
FIG. 6 is an enlarged view of the encircled area designated "6" in FIG. 5.

As indicated in FIGS. 5 and 6, the edge portions of the outer portions of felt layer 17 are slanted upwardly and outwardly at 28 to facilitate wrapping of the completed polyurethane and felt strip body around the racquet handle 14. The central portion of the underside 30 of the felt layer is provided with a conventional layer of adhesive 34 which is originally covered with a protective quick-release tape 35. To apply the grip G to the racquet handle 14, the protective tape 35 is stripped off the adhesive 34, as indicated in FIG. 4. Thereafter, the body of bonded-together strip of polyurethane and felt is tightly wrapped around the racquet handle 14, as is conventional in mounting tennis handle grips of this type.

The inflatable tube 21 is preferably formed of silicon rubber which is stitched to the grip body 16 by suitable thread 38, preferably made of polyester. As indicated in FIGS. 4 and 6, the thread 38 extends along the length of the grip body 16, passing along the interior of the body transversely across the inner surface 18 of the felt layer 17 in a zig-zag pattern, with each stitch extending vertically through the polyurethane layer 20 on either side of the tube 21 to define a pair of parallel runs 40 (FIG. 3), which abut the opposite sides of the tube. Referring to FIG. 9, it will be noted the thread 38 extends through the polyurethane and felt layers adjacent the top and bottom of the tube 21. Referring now to FIG. 10, when the pump 22 is operated so as to inflate tube 21, the profile of the grip G adjacent the tube 21 extends radially outwardly compared to its initial condition of FIG. 9, as indicated by the arrows 44 and 46.

The air pump 22 may be of conventional construction so long as it serves to selectively pressurize the interior of the tube 21 at a desired pressure. The preferred form of pump 22 shown in the drawings includes a pump body 48, preferably formed of a resilient synthetic plastic such as silicon rubber. The pump body includes a base 50 which abuts the racquet handle 14 and is removeably adhered thereto by adhesive 32. The outer portion of pump body 48 is formed with a dome-shaped bulb 52 defining a pump chamber 54. The downstream side of pump chamber 54 is in communication with a downstream valve chamber 56 which houses a pointed check valve 58 that engages valve seat 60. The upper end of tube 21 is secured to an outlet passage 62 connected with valve chamber 56. As indicated in FIG. 8, the end of the check valve 58 remote from valve seat 60 is formed with air grooves 64. The upstream end of pump chamber 54 is in communication with a an atmospheric or upstream valve chamber 66 which receives a second check valve 68 having air grooves 69. The pointed end 70 of the check valve 68 engages an upstream valve seat 72 in communication with the atmosphere through air passage 74. Downstream check valve chamber 56 is provided with a pressure-release plunger 76.

The tube 21 is pressurized by manual depression of the bulb 52, such depression forcing air into the tube from pump chamber 54 around air grooves 64 of the downstream check valve 58, and past the valve seat 60 into outlet passage 62, the upstream check valve 68 being forced into a closed position. Atmospheric air enters the pump chamber 54 through second check valve 68 when the bulb is released to return to its original position. The pressure of the air within tube 21, and hence the degree of expansion of tube 21 is controlled by the operation of bulb 52. Air pressure in tube 21 above the desired magnitude can be released by merely pushing inwardly on the pressure-release plunger 76 of the upstream check valve 58.

The provision of the spiral profile permits the racquet user to maintain firm hand contact with the grip G even when the user's hand is moist from perspiration. In this regard, the exterior surface of the polyurethane layer 20 provides "tackiness", which when taken with the added surface area provided by the spiral profile, assures a firm contact of the racquet user's hand with the grip G at all times, even when the ball is not struck in the center portion of the racquet. This advantage can be enhanced by the provision of the vertical pores in the polyurethane layer 20 Additionally, the cushioning provided by the grip G reduces the shock to the user's hand and arm parts so as to inhibit "tennis elbow" injuries. It should further be noted that the use of the perforations 25 through the polyurethane and felt layers not only increase absorption and allow for faster drying of grip, but also further enhances the cushioning effect of the grip G by providing a controlled restriction of air escaping from within the pores of the textile layer when the grip is grasped by the racquet user.

Referring now to FIGS. 11–16, there is shown a second embodiment of a racquet grip G' embodying the present invention utilizing an inflatable tube 80 which is embedded in the polyurethane layer 81. Like parts bear primed reference numerals. The body of grip G' is of a sleeve-type configuration rather than the strip configuration of FIGS. 1–10.

With continued reference to FIGS. 11–16, the inflatable tube 80 is first wrapped around the exterior of a felt layer 82, and thereafter, the polyurethane layer 81 is integrally formed over the tube. This construction can be readily accomplished by means of the mold M shown in FIGS. 13 and 14. Such mold M is of the split cylinder type employing a vertical central post 83 and two split cylinders 84 and 85 coaxial therewith. The bottom of the post 83 is secured co-axially within a split cup-shaped base 85 having flanges 86 that rigidly receive the lower portions of the split cylinders 84 and 85. The split cylinders may be releasably secured in a conventional manner as by suitable fastening means (not shown).

In the operation of mold M, felt layer 82 is applied about the post 83. The tube 80 in its relaxed state is then wrapped about the outer surface of the felt layer in a spiral configuration and adhered to the felt. Thereafter, polyurethane is pored into the annular space separating the outer surface of the felt layer 82 and the inner surfaces of the split cylinders 84 and 85. The mold M containing molten polyurethane is plunged into a cooling bath for a few seconds to cause the polyurethane to coagulate and form the layer 81 having transversely extending pores 90, with the polyurethane layer bonding to the outer surface of the felt layer and to the external surfaces of the tube 80. The split cylinders 84 and 85 are then separated and the completed grip G, removed from the mold M.

Referring again to FIGS. 13 and 14, the air pump 22' may utilize the same construction described hereinbefore with respect to the first embodiment of the invention shown in FIGS. 1-10. Before the grip G' is inflated by pump 22', it will have the appearance shown in FIGS. 11 and 15. The pump 22' is then operated so as to pressurize the tube 80 and thereby expand the area of the grip body in a raised profile configuration adjacent the tube along the racquet handle 14.

Various modifications and changes may be made with respect to the foregoing detailed description without departing from the spirit of the invention. By way of example, a fluid other than air may be employed to pressurize the tube, and a pump arrangement other than described hereinbefore may be utilized.

I claim:

1. The combination of a handle of a ball-struck impact imparting device and a shock absorbing grip, wherein said shock absorbing grip comprises:

a resilient, compressible body which is adhered over said handle;

an inflatable tube interposed between the interior of the body and the handle; and pump means on the body to selectively pressurize the tube and thereby expand the area of the body in a raised profile configuration adjacent the tube.

2. A shock absorbing grip as set forth in claim 1, wherein the tube follows a spiral configuration around the grip and handle.

3. A shock absorbing grip as set forth in claim 1, wherein the body essentially consists of an open-pored textile layer having an inner surface adhered directly to the handle, and a smooth closed pore polyurethane layer having its inner surface adhered to the outer surface of the textile layer remote from the handle.

4. A shock absorbing grip as set forth in claim 3, wherein a plurality of perforations extend through said layers.

5. A shock absorbing grip as set forth in claim 3, which further includes an air pump formed on the body and having a pump body formed with a dome-shaped bulb in communication with the tube and with the atmosphere, and with the pump body also incorporating valve means to control the flow of air into and out of the tube.

6. A shock absorbing grip as set forth in claim 1, wherein the body further includes an air pump having a pump body formed with a dome-shaped bulb in communication with the tube and with the atmosphere, and with the pump body also incorporating valve means to control the flow of air into and out of the tube.

7. A shock absorbing grip as set forth in claim 1, wherein the tube is stitched to the body by thread that extends along the length of the body along opposite sides of the tube.

8. A shock absorbing grip as set forth in claim 1, wherein the tube is molded into the body.

9. A shock absorbing grip as set forth in claim 1, wherein the body is an elongated strip wrapped spirally around the handle of the impact impacting device.

10. A shock absorbing grip as set forth in claim 1, wherein the body is sleeve-shaped.

11. A shock absorbing grip as set forth in claim 10, wherein the body essentially consists of an open-pored textile layer having an inner surface adhered directly to the handle, and a smooth closed pore polyurethane layer having its inner surface adhered to the outer surface of the textile layer remote from the handle, with the tube being affixed to the intermediate portion of the strip.

* * * * *